US010094379B2

(12) United States Patent
Won et al.

(10) Patent No.: US 10,094,379 B2
(45) Date of Patent: Oct. 9, 2018

(54) SCROLL COMPRESSOR

(71) Applicant: Halla Visteon Climate Control Corp., Daejeon (KR)

(72) Inventors: Jong Bo Won, Daejeon (KR); Il Young Park, Daejeon (KR); Kweon Soo Lim, Daejeon (KR)

(73) Assignee: HANON SYSTEMS, Daejeon-si (KR)

( * ) Notice: Subject to any disclaimer, the term of this patent is extended or adjusted under 35 U.S.C. 154(b) by 207 days.

(21) Appl. No.: 14/224,504

(22) Filed: Mar. 25, 2014

(65) Prior Publication Data

US 2015/0010417 A1 Jan. 8, 2015

(30) Foreign Application Priority Data

Jul. 2, 2013 (KR) ..... 10 2013 0076853
Feb. 27, 2014 (KR) ..... 10 2014 0023125

(51) Int. Cl.

| | |
|---|---|
| ***F04C 29/00*** | (2006.01) |
| ***F04C 18/02*** | (2006.01) |
| ***F04C 23/00*** | (2006.01) |
| ***F04C 27/00*** | (2006.01) |

(52) U.S. Cl.

CPC ..... *F04C 18/0215* (2013.01); *F04C 18/0261* (2013.01); *F04C 23/008* (2013.01); *F04C 27/005* (2013.01); *F04C 2270/185* (2013.01)

(58) Field of Classification Search

CPC .. F04C 18/0215; F04C 23/008; F04C 27/005; Y10T 137/7796
USPC ..... 418/15, 55.4, 55.5
See application file for complete search history.

(56) References Cited

U.S. PATENT DOCUMENTS 4,596,520 A * 6/1986 Arata et al. ..... 418/55.5
6,299,417 B1 * 10/2001 Shin ..... F16K 15/025 137/540
6,589,035 B1 * 7/2003 Tsubono et al. ..... 418/55.5
6,616,431 B2 * 9/2003 Kitano ..... F04C 29/021 418/55.6
6,761,545 B1 7/2004 Witham et al.
7,419,370 B2 * 9/2008 Masuda ..... F04C 18/0215 418/55.4

(Continued)

FOREIGN PATENT DOCUMENTS

JP 10-110688 4/1998
JP 10110688 A * 4/1998 ..... F04C 18/0215

(Continued)

OTHER PUBLICATIONS

KR 20130074392, Machine Translation, Translated on Jul. 19, 2017.*

*Primary Examiner* — Patrick Maines
(74) *Attorney, Agent, or Firm* — Shumaker, Loop & Kendrick, LLP; James D. Miller

(57) ABSTRACT

Disclosed herein is a scroll compressor in which refrigerant is compressed in a compression chamber while the volume of the compression chamber is gradually decreased due to relative rotation of a fixed scroll and an orbiting scroll. In accordance with the disclosure, the scroll compressor is provided in which a pressure in a back-pressure chamber is managed in connection with a discharge refrigerant pressure so that the orbiting scroll is supported by the pressure in the back-pressure chamber without a power loss or an inner leak in an overall pressure section of a scroll.

13 Claims, 6 Drawing Sheets

(56) References Cited

U.S. PATENT DOCUMENTS

| | | | | |
|---|---|---|---|---|
| 2004/0136855 | A1 | 7/2004 | Kimura et al. | |
| 2011/0135524 | A1* | 6/2011 | Tang | 418/55.4 |
| 2013/0189144 | A1* | 7/2013 | Yamamoto | F04C 18/0215 418/55.1 |

FOREIGN PATENT DOCUMENTS

| | | | | |
|---|---|---|---|---|
| JP | 2002087882 | A | | 3/2002 |
| JP | 2002227781 | A | | 8/2002 |
| JP | 2013019293 | | | 1/2013 |
| KR | 1020040001353 | B1 | | 3/2006 |
| KR | 20060044336 | A | | 5/2006 |
| KR | 1020040092067 | B1 | | 5/2006 |
| KR | 1020060053798 | B1 | | 11/2007 |
| KR | 20080052275 | A | | 6/2008 |
| KR | 20130074392 | A | * | 7/2013 |

* cited by examiner

SCROLL COMPRESSOR

CROSS-REFERENCE(S) TO RELATED APPLICATIONS

This application claims priority to Korean Patent Application Nos. 10-2013-0076853 filed on Jul. 2, 2013 and 10-2014-0023125 and Feb. 27, 2014, respectively, the disclosures of which are incorporated herein by reference in their entirety.

FIELD OF THE INVENTION

Exemplary embodiments of the present invention relate to a scroll compressor, and more particularly, to a scroll compressor in which a pressure in a back-pressure chamber acting on a back surface of an orbiting scroll is regulated depending on a pressure in a discharge chamber.

BACKGROUND OF THE INVENTION

In general, a compressor serving to compress refrigerant in a cooling system for a vehicle has been developed in various forms. Such a compressor includes a reciprocating compressor which compresses refrigerant during reciprocation and a rotary compressor which compresses refrigerant during rotation.

Here, the reciprocating compressor includes a crank compressor which transfers driving force of a drive source to a plurality of pistons using a crank, a swash plate compressor which transfers driving force of a drive source to a rotary shaft equipped with a swash plate, and a wobble plate compressor which utilizes a wobble plate, and the rotary compressor includes a vane compressor which utilizes a rotary shaft and a vane and a scroll compressor which utilizes an orbiting scroll and a fixed scroll.

FIG. 1 shows a configuration of a scroll compressor according to the related art. Referring to FIG. 1, the scroll compressor includes a drive portion 20, a compression portion 30, and a control portion 40 which are installed inside a housing 10 defining an external appearance thereof. A space within the housing 10 is divided into a suction chamber 50, a compression chamber 60, a discharge chamber 70, and a back-pressure chamber 80.

The drive portion 20 includes a stator 21 and a rotor 22 which are coaxially mounted inside the housing 10, and a rotary shaft 23 installed therethrough. The compression portion 30 includes a fixed scroll 31 fixed to one side within the housing 10 and an orbiting scroll 32 which defines the compression chamber 60 by engaging with a fixed scroll 31 while being eccentrically rotated by the drive portion 20. In this case, the orbiting scroll 32 is eccentrically coupled to the rotary shaft 23 by an eccentric bush 24.

In addition, the control portion 40 includes a variety of drive circuits and elements such as a PCB mounted inside the housing 10.

The suction chamber 50 is a space in which refrigerant introduced from the outside of the housing 10 is stored. The compression chamber 60 is a space in which refrigerant introduced into the suction chamber 50 is compressed. The discharge chamber 70 is a space to which refrigerant compressed in the compression chamber 60 is discharged. The back-pressure chamber 80 is a space in which a pressure is defined such that the orbiting scroll 32 is pressed toward the fixed scroll 31.

Hereinafter, a description will be given of a process of compressing refrigerant by the scroll compressor having the above-mentioned configuration. First, when external electric power is applied to the control portion 40 through connection terminals or the like, the control portion 40 transmits operation signals to the drive portion 20 through the drive circuits or the like.

When the operation signals are transmitted to the drive portion 20, the stator 21 in the form of an electromagnet, which is press-fitted on an inner peripheral surface of the housing 10, is energized and magnetized, and thus an electromagnetic interaction is generated between the rotor 22 and the stator 21 so that the rotor 22 rotates at high speed.

In this case, when the rotary shaft 23 of the drive portion 20 rotates at a high speed along with the rotor 22, the orbiting scroll 32 of the compression chamber 30 eccentrically coupled to a rear end of the rotary shaft 23 is synchronized therewith and eccentrically rotates at high speed. Consequently, as the orbiting scroll 32 revolves around the fixed scroll 31 with which the orbiting scroll 32 is matched in the form of facing each other, refrigerant flowing from the suction chamber 50 to the compression chamber 60 is compressed to high pressure while being directed from an outer periphery of the scroll to a central portion thereof, and is then discharged to the discharge chamber 70. Accordingly, a series of refrigerant compression operations is completed.

Meanwhile, refrigerant discharged to the discharge chamber 70 is transferred outside the housing 10 and a portion of the refrigerant is transferred to the back-pressure chamber 80. Then, a pressure is generated in the back-pressure chamber 80 by the refrigerant transferred to the back-pressure chamber 80 and the orbiting scroll 32 is pressed toward the fixed scroll 31 by the pressure, thereby enabling the compression chamber 60 to be sealed while the orbiting scroll 32 is pressed against the fixed scroll 31 without a gap therebetween.

Here, a pressure in the back-pressure chamber 80 is regulated in response to a pressure in the suction chamber 50 through a check valve 90 installed in the back-pressure chamber 80. That is, when the pressure in the back-pressure chamber 80 is higher than the pressure in the suction chamber 50 by more than a certain magnitude, the check valve 90 is opened such that refrigerant in the back-pressure chamber 80 is transferred to the suction chamber 50. As a result, the pressure in the back-pressure chamber 80 is maintained to be higher than the pressure in the suction chamber 50 only by the certain magnitude.

This configuration in which the check valve 90 is operated by a pressure differential between the suction chamber 50 and the back-pressure chamber 80 so as to regulate the pressure in the back-pressure chamber 80 is disclosed in Japanese Unexamined Patent Application Publication No. 1998-110688, published on Apr. 28, 1998 (Patent Document 1).

However, in a scroll section of the compression chamber 60 in which a high pressure is defined, a discharge pressure is higher compared to a pressure in the back-pressure chamber 80. Therefore, the orbiting scroll 32 slightly moves toward the back-pressure chamber 80 with the consequence that an inner leak is caused due to a gap generated between the fixed scroll 31 and the orbiting scroll 32.

In addition, in a scroll section of the compression chamber 60 in which a relatively low pressure is defined, the pressure in the back-pressure chamber 80 is higher compared to the discharge pressure. Therefore, the orbiting scroll 32 is excessively pressed toward the fixed scroll 31 with the consequence that electric power is significantly required to drive the orbiting scroll 32.

Moreover, in a case of managing the pressure in the back-pressure chamber 80 in connection with the pressure in the suction chamber 50 as in Patent Document 1, a cross-sectional area of a suction passage and the like are non-uniform in size and temperature of refrigerant is increased by the stator 21 heated to high temperature in the suction chamber 50. Consequently, back-pressure management may be disadvantageous due to an error occurring between a measured suction refrigerant pressure and an actual refrigerant pressure in the suction chamber.

SUMMARY OF THE INVENTION

An object of the present invention is to provide a scroll compressor in which a pressure in a back-pressure chamber is managed in connection with a discharge refrigerant pressure so that an orbiting scroll is supported by the pressure in the back-pressure chamber without an inner leak in an overall pressure section of a scroll.

Other objects and advantages of the present invention can be understood by the following description, and become apparent with reference to the embodiments of the present invention. Also, it will become apparent to those skilled in the art to which the present invention pertains that the objects and advantages of the present invention can be realized by the means as claimed and combinations thereof.

In accordance with one aspect of the present invention, a scroll compressor includes a housing which is provided, at an outer peripheral surface thereof, with a suction port and a discharge port spaced apart from each other and is formed therein with a suction chamber and a discharge chamber, a fixed scroll which is installed to one side within the housing and is formed with an outlet communicating with the discharge chamber, the outlet being penetratively formed at a center of the fixed scroll, a drive motor which is mounted to the other side within the housing and is provided with a rotary shaft, an orbiting scroll which is eccentrically coupled to one side end of the rotary shaft to revolve around the fixed scroll and defines a plurality of compression chambers together with the fixed scroll, a back-pressure chamber which is defined between the orbiting scroll and the rotary shaft to allow the orbiting scroll to be supported toward the fixed scroll, a back-pressure regulation passage including a first passage through which the discharge chamber communicates with the back-pressure chamber and a second passage through which the back-pressure chamber communicates with the suction chamber, and a pressure regulation unit which is installed on the back-pressure regulation passage to regulate a pressure in the back-pressure chamber depending on a pressure on the discharge chamber.

The pressure regulation unit may include a check valve which is provided on the first passage to open and close the first passage depending on the pressure in the discharge chamber.

The pressure regulation unit may further include an orifice provided on the second passage.

The pressure regulation unit may include an orifice provided on the first passage, and the pressure regulation unit may further include an orifice provided on the second passage.

Refrigerant of the back-pressure chamber may be introduced through the orifice into the suction chamber.

The first passage may include a 1-1 passage formed at one side of the fixed scroll and a 1-2 passage formed at one side of the housing so as to communicate with the 1-1 passage.

The second passage may include a 2-1 passage formed from one end of the rotary shaft in a longitudinal direction thereof and a 2-2 passage formed from a distal end of the 2-1 passage in an outer peripheral surface direction of the rotary shaft.

In accordance with another aspect of the present invention, a scroll compressor includes a housing which is provided, at an outer peripheral surface thereof, with a suction port and a discharge port spaced apart from each other and is formed therein with a suction chamber and a discharge chamber, a fixed scroll which is installed to one side within the housing and is formed with an outlet communicating with the discharge chamber, the outlet being penetratively formed at a center of the fixed scroll, a drive motor which is mounted to the other side within the housing and is provided with a rotary shaft, an orbiting scroll which is eccentrically coupled to one side end of the rotary shaft to revolve around the fixed scroll and defines a plurality of compression chambers together with the fixed scroll, a back-pressure chamber which is defined between the orbiting scroll and the rotary shaft to allow the orbiting scroll to be supported toward the fixed scroll, and a back-pressure regulation passage including a first passage through which the discharge chamber communicates with the back-pressure chamber, the first passage being made in the form of an orifice hole at one side of the housing, and a second passage through which the back-pressure chamber communicates with the suction chamber.

The scroll compressor may further include an orifice provided on the second passage.

The first passage may include a 1-1 passage formed at one side of the fixed scroll such that one end of the 1-1 passage communicates with the discharge chamber, and a 1-2 passage configured such that one end of the 1-2 passage communicates with the 1-1 passage and the other end thereof communicates with one side of the back-pressure chamber.

The second passage may include a 2-1 passage formed from one end of the rotary shaft in a longitudinal direction thereof and a 2-2 passage formed from a distal end of the 2-1 passage in an outer peripheral surface direction of the rotary shaft.

It is to be understood that both the foregoing general description and the following detailed description of the present invention are exemplary and explanatory and are intended to provide further explanation of the invention as claimed.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF EXEMPLARY EMBODIMENTS OF THE INVENTION

Figure 1:
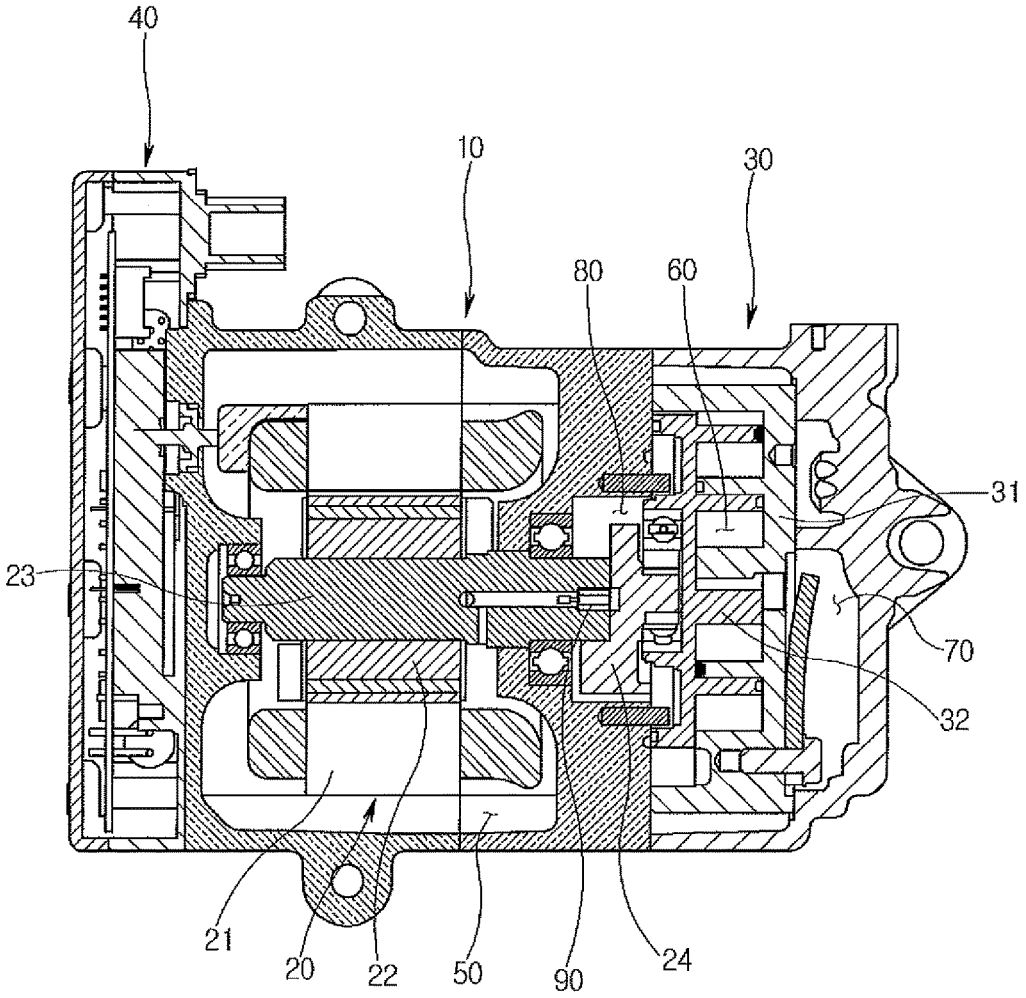
Fig.1 (Prior Art)
FIG. 1 is a cross-sectional view illustrating a scroll compressor according to the related art.

Hereinafter, a scroll compressor according to exemplary embodiments of the present invention will be described in more detail with reference to the accompanying drawings. In the description, the thickness of each line or the size of each component illustrated in the drawings may be exaggerated for convenience of description and clarity.

In addition, terms to be described later are terms defined in consideration of functions of the present invention, and these may vary with the intention or practice of a user or an operator. Therefore, such terms should be defined based on the entire content disclosed herein.

In addition, the following embodiments are for the purpose of describing the components set forth in the appended claims only and are not intended to limit the spirit and scope of the invention. More particularly, various variations and modifications are possible in concrete constituent elements of the embodiments, and it is to be understood that differences relevant to the variations and modifications fall within the spirit and scope of the present disclosure defined in the appended claims.

Embodiments

Figure 2:
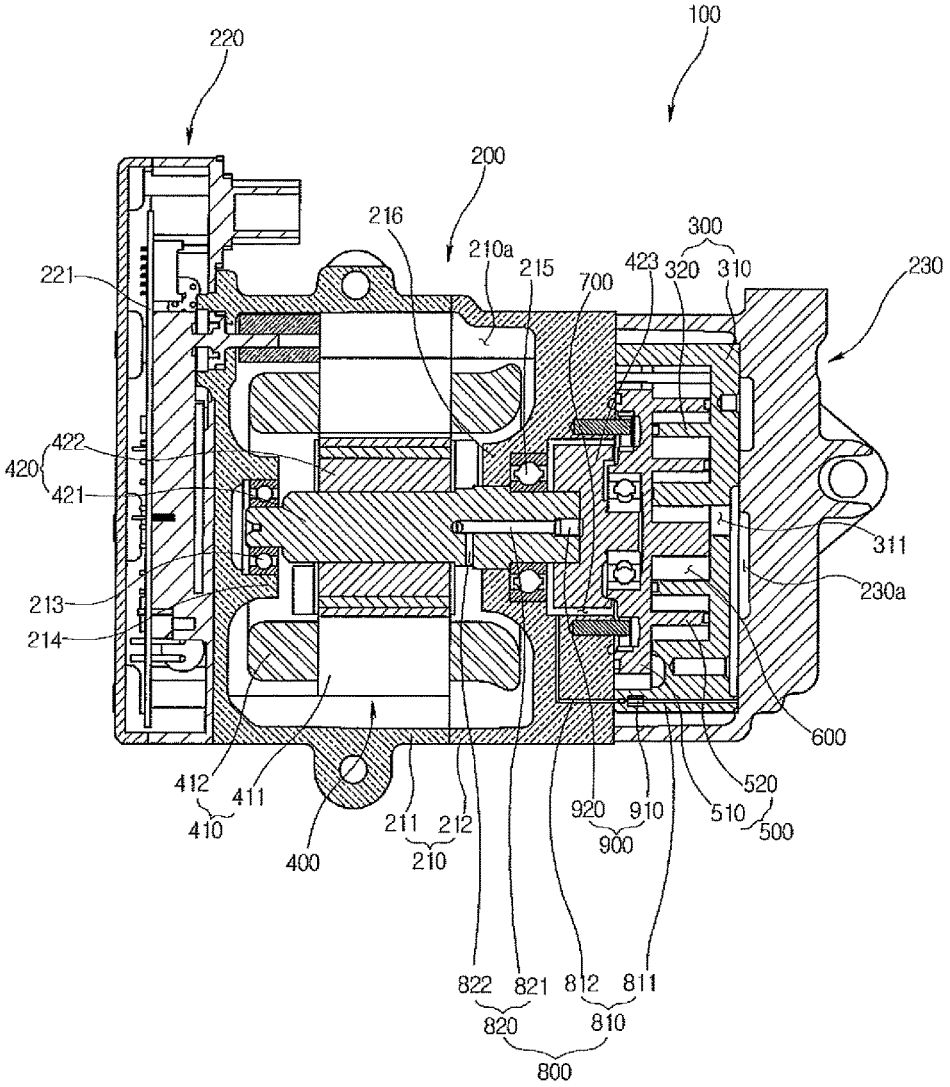
FIG. 2 is a cross-sectional view illustrating a scroll compressor according to a first embodiment of the present invention.

FIG. 2 is a cross-sectional view illustrating a scroll compressor 100 according to a first embodiment of the present invention.

As shown in FIG. 2, the scroll compressor 100 according to a first embodiment of the present invention includes a housing 200 having a substantially hollow cylindrical shape, a fixed scroll 300 installed to one side within the housing 200, a drive motor 400 installed to the other side within the housing 200, an orbiting scroll 500 eccentrically coupled to one side end of a rotary shaft 421 of the drive motor 400 to revolve around the fixed scroll 300, and a back-pressure chamber 700 defined between the orbiting scroll 500 and the rotary shaft 421.

In this case, the housing 200 is formed with a back-pressure regulation passage 800 through which a discharge chamber 230*a*, the back-pressure chamber 700, and a suction chamber 210*a* communicate with each other, and one side of the back-pressure regulation passage 800 is equipped with a pressure regulation unit 900 to regulate a pressure in the back-pressure chamber 700 depending on a pressure in the discharge chamber 230*a*.

Here, the housing 200 defines an entire external appearance of the scroll compressor 100, and includes a drive portion housing 210 to mount the drive motor 400 therein, a head housing 220 which is coupled to the front of the drive portion housing 210 and is provided therein with an inverter 221 for control of the drive motor 400, and a cover housing 230 which is coupled to the rear of the drive portion housing 210.

One side of an outer peripheral surface of the drive portion housing 210 is formed with a suction port (not shown) through which refrigerant is introduced into the suction chamber 210*a*, and one side of an outer peripheral surface of the cover housing 230 is formed with a discharge port (not shown) through which refrigerant is supplied to the outside. The discharge port communicates with the discharge chamber 230*a* defined inside the cover housing 230.

In this case, the drive portion housing 210, the head housing 220, and the cover housing 230 may be modified in various shapes, and the housing 200 may also be formed as a whole in various configurations. For example, the drive portion housing 210 may be formed as two parts such as a front housing 211 and a rear housing 212 which are coupled to face each other, as shown in FIG. 2. Besides, the front and rear housings 211 and 212 may be formed integrally with each other, or the drive portion housing 210 and the head housing 220 or the drive portion housing 210 and the cover housing 230 may also be formed integrally with each other.

The drive portion housing 210 is formed therein with a space portion defining the suction chamber 210*a* and the drive motor 400 is mounted in the space portion.

The drive motor 400 includes a stator 410 and a rotor 420. In this case, the stator 410 has a cylindrical shape penetrated at a center thereof. The stator 410 includes a stator core 411 fixedly mounted on an inner peripheral surface of the drive portion housing 210 by press-fitting or the like and a bundle of coils 412 wound around the stator core 411.

The rotor 420 is coaxially mounted inside the stator 410 to be rotatably driven. The rotor 420 may include the rotary shaft 421 which is rotatably inserted into a central through-hole of the stator core 411 to be longitudinally arranged along a central axis thereof, and a permanent magnet 422 attached on an outer peripheral surface of the rotary shaft 421.

Accordingly, when an electrical current flows in the coils 412 wound around the stator core 411, a magnetic field is generated in the stator core 411 and the rotary shaft 421 is rotatably driven by an interaction between the stator 410 and the permanent magnet 422 according to the driving principle of the motor.

In this case, the bottom of the front housing 211 is protrusively formed with a first bearing accommodation portion 214 in which a first bearing 213 is fixedly installed, and the bottom of the rear housing 212 is protrusively formed with a second bearing accommodation portion 216 in which a second bearing 215 is fixedly installed. The rotary shaft 421 of the drive motor 400 is rotatably supported at a front end thereof by the first bearing 213 while being rotatably supported at a rear end thereof by the second bearing 215.

Meanwhile, although not shown, one side of the outer peripheral surface of the drive portion housing 210 is formed with the suction port for introduction of refrigerant. Refrigerant introduced into the suction chamber 210 in the drive portion housing 210 through the suction port is compressed to high pressure in a plurality of compression chambers 600 to be described later and is discharged to the discharge chamber 230*a*. The refrigerant is then supplied to the outside through the discharge port spaced apart from the suction port.

The head housing 220 is coupled to the front of the drive portion housing 210 and is provided therein with the inverter 221 to convert direct current power into alternating current power. The inverter 221 controls rotational speed of the drive motor 400 so as to uniformly maintain the interior of a vehicle to a desired temperature by controlling a compression amount of refrigerant.

The rear of the drive portion housing 210 is coupled with the cover housing 230 provided with the discharge port at one side of the outer peripheral surface thereof. The fixed scroll 300 and the orbiting scroll 500 are installed inside the cover housing 230 so as to face each other.

The fixed scroll 300 includes a fixed single plate 310 having a disc shape, and a fixed wrap 320 which is protrusively formed in a spiral form so as to converge from one surface of the fixed single plate 310 toward a center thereof. In addition, the orbiting scroll 500 includes an orbiting single plate 510 having a disc shape, and an orbiting wrap 520 which is protrusively formed in a spiral form so as to converge from one surface of the orbiting single plate 510 toward a center thereof.

In this case, the fixed scroll 300 is fixedly installed to one side within the cover housing 230 and the orbiting scroll 500 is installed to the other side within the cover housing 230 so as to face the fixed scroll 300. The orbiting scroll 500 is eccentrically coupled to one side end of the rotary shaft 421 by an eccentric bush 423 and revolves around the fixed scroll 300 during rotation of the rotary shaft 421.

During revolution of the orbiting scroll 500 around the fixed scroll 300, the fixed wrap 320 and the orbiting wrap 520 come into contact with each other at multiple points. In this case, a space between the fixed wrap 320 and the orbiting wrap 520 is divided into the plurality of compression chambers 600. That is, the fixed scroll 300 and the orbiting scroll 500 are matched with each other when the orbiting scroll 500 revolves. Consequently, refrigerant introduced to outer peripheral portions of the fixed wrap 320 and the orbiting wrap 520 is compressed while being directed toward central portions thereof, due to relative rotation of the fixed wrap 320 and the orbiting wrap 520, and is then discharged to the discharge chamber 230*a* in the cover housing 230 through an outlet 311 penetratively formed at the center of the fixed scroll 300.

Subsequently, the refrigerant discharged to the discharge chamber 230*a* is supplied through the discharge port to the outside.

Meanwhile, the back-pressure chamber 700 is formed in one side of the hollow of the rear housing 212. The back-pressure chamber 700 is formed on the back surface of the orbiting scroll 500, namely, between one surface of the orbiting single plate 510 facing the rotary shaft 421 and one side end of the rotary shaft 421.

In more detail, the back-pressure chamber 700 is formed across a coupling portion of the eccentric bush 423 to the orbiting single plate 510 and a rotation space of the eccentric bush 423. The orbiting scroll 500 is pressed toward the fixed scroll 300 by the pressure of refrigerant introduced into the back-pressure chamber 700.

In this case, in the scroll compressor 100 according to the first embodiment of the present invention, the pressure in the back-pressure chamber 700 is regulated in connection with the pressure in the discharge chamber 230*a*.

To this end, the housing 200 is formed therein with the back-pressure regulation passage 800 including a first passage 810 through which the discharge chamber 230*a* communicates with the back-pressure chamber 700 and a second passage 820 through which the back-pressure chamber 700 communicates with the suction chamber 210*a*.

In addition, the pressure regulation unit 900 is installed to one side of the back-pressure regulation passage 800. The pressure regulation unit 900 includes a check valve 910 installed on one side of the first passage 810 and an orifice 920 installed on one side of the second passage 820.

Here, the first passage 810 includes a 1-1 passage 811 which passes through the inside of one side of the fixed scroll 300 such that one end of the 1-1 passage 811 communicates with the discharge chamber 230*a*, and a 1-2 passage 812 which is bent at one side within the rear housing 212 such that one end of the 1-2 passage 812 communicates with the 1-1 passage 811 and the other end thereof communicates with one side of the back-pressure chamber 700.

In this case, the check valve 910 is installed on one side of the first passage 810. Although FIG. 2 illustrates an example of installing the check valve 910 on one side of the 1-1 passage 811, the present invention is not limited thereto. For example, the check valve 910 may also be installed on one side of the 1-2 passage 812 as necessary.

The first passage 810 is openably and closably operated by the check valve 910 installed on the first passage 810. That is, when a pressure differential between the discharge chamber 230*a* and the back-pressure chamber 700 is greater than a preset pressure differential of the check valve 910, the check valve is opened so that refrigerant of the discharge chamber 230*a* is introduced into the back-pressure chamber 700.

Subsequently, the pressure in back-pressure chamber 700 increases while the refrigerant of the discharge chamber 230*a* is continuously introduced through the first passage 810 into the back-pressure chamber 700. When the pressure differential between the discharge chamber 230*a* and the back-pressure chamber 700 is less than the preset pressure differential of the check valve 910 by an increase in pressure in the back-pressure chamber 700, the check valve 910 is again closed so that refrigerant is prevented from flowing from the discharge chamber 230*a* to the back-pressure chamber 700.

The second passage 820 includes a 2-1 passage 821 which extends inward from one side end of the rotary shaft 421 in a longitudinal direction thereof such that one end of the 2-1 passage 821 communicates with the back-pressure chamber 700, and a 2-2 passage 822 one end of which communicates with the other end of the 2-1 passage 821 while the other end of the 2-2 passage 822 extends in an outer peripheral surface direction of the rotary shaft 421 to communicate with one side of the suction chamber 210*a*.

The orifice 920 is installed on the second passage 820 and refrigerant passing through the orifice 920 is introduced into the suction chamber 210*a*. In this case, the pressure in the back-pressure chamber 700 should be maintained to a degree of pressing the orbiting scroll 500 toward the fixed scroll 300. Accordingly, the orifice 920 preferably has high volume resistivity of fluid such that an amount of refrigerant discharged to the suction chamber 210*a* is less than an amount of refrigerant introduced into the back-pressure chamber 700.

Figure 3:
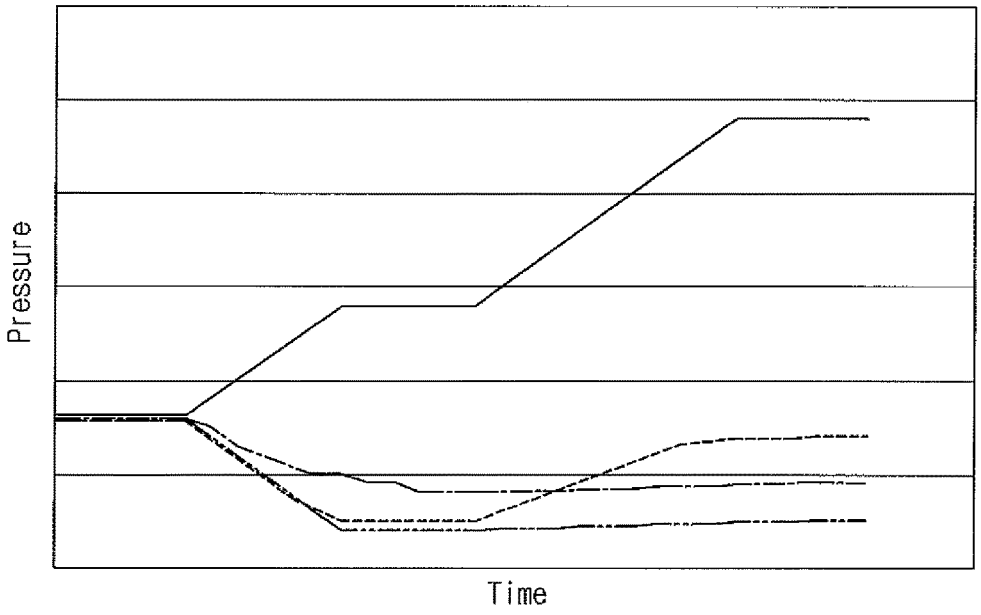
FIG. 3 is a graph illustrating a relationship between a pressure in a back-pressure chamber and a discharge pressure in the scroll compressor according to the first embodiment of the present invention.

FIG. 3 is a graph illustrating a relationship between a pressure in the back-pressure chamber and a discharge pressure in the scroll compressor according to the first embodiment of the present invention. Here, the solid line indicates a change in discharge pressure according to time and the alternate long and two short dashes line indicates a change in suction pressure according to time.

In FIG. 3, a conventional change in pressure in a back-pressure chamber indicated by the alternate long and short dash line shows a form of following a change in suction pressure indicated by the alternate long and two short dashes line according to lapse of time. That is, in a conventional compressor, the pressure in the back-pressure chamber is managed within a predetermined range on the basis of the suction pressure.

On the other hand, in accordance with the first embodiment of the present invention, as indicated by the dotted line in FIG. 3, the change in pressure in the back-pressure chamber 700 shows a form of following the change in discharge pressure (solid line) according to lapse of time. That is, the pressure in the back-pressure chamber 700 is managed within a predetermined range on the basis of the pressure in the discharge chamber 230*a* by the check valve 910 installed on the first passage 810.

Figure 4:
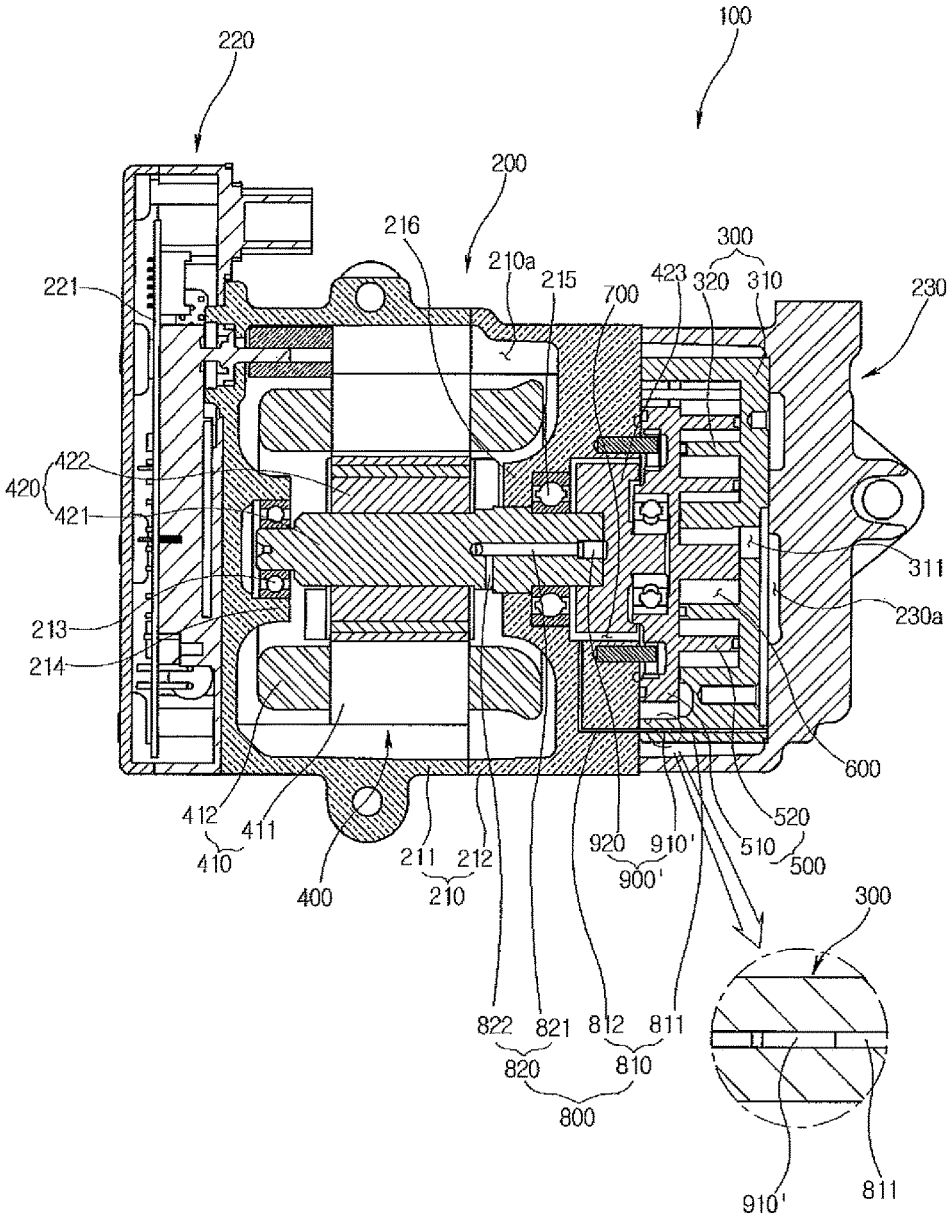
FIG. 4 is a cross-sectional view illustrating a scroll compressor according to a second embodiment of the present invention.

FIG. 4 is a cross-sectional view illustrating a scroll compressor according to a second embodiment of the present invention.

The second embodiment shown in FIG. 4 has configurations similar to the first embodiment described above with reference to FIG. 2, but differs from the first embodiment in that an orifice 910' is installed on one side of the first passage 811 instead of the check valve 910 of the first embodiment. Thus, the same functional configurations as those of the above-mentioned first embodiment are designated by the like reference numerals and no description will be given thereof.

A pressure regulation unit 900' according to the second embodiment of the present invention includes the orifice 910' installed on one side of the first passage 811.

The orifice 910' may be installed on one side of the 1-1 passage 811 or the 1-2 passage 812. The orifice 910' serves as fluid resistance with respect to the flow of refrigerant, thereby regulating an amount of refrigerant introduced from the discharge chamber 230*a* to the back-pressure chamber 700 so that the pressure in the back-pressure chamber 700 is regulated in response to the pressure in the discharge chamber 230*a*.

When such an orifice 910' is used, it may be possible to reduce costs compared to the use of the check valve 910. Since the pressure in the back-pressure chamber 700 is always higher than the pressure in the suction chamber 210*a*, it may be possible to further enhance performance of the compressor by the prevention of an inner leak.

Figure 5:
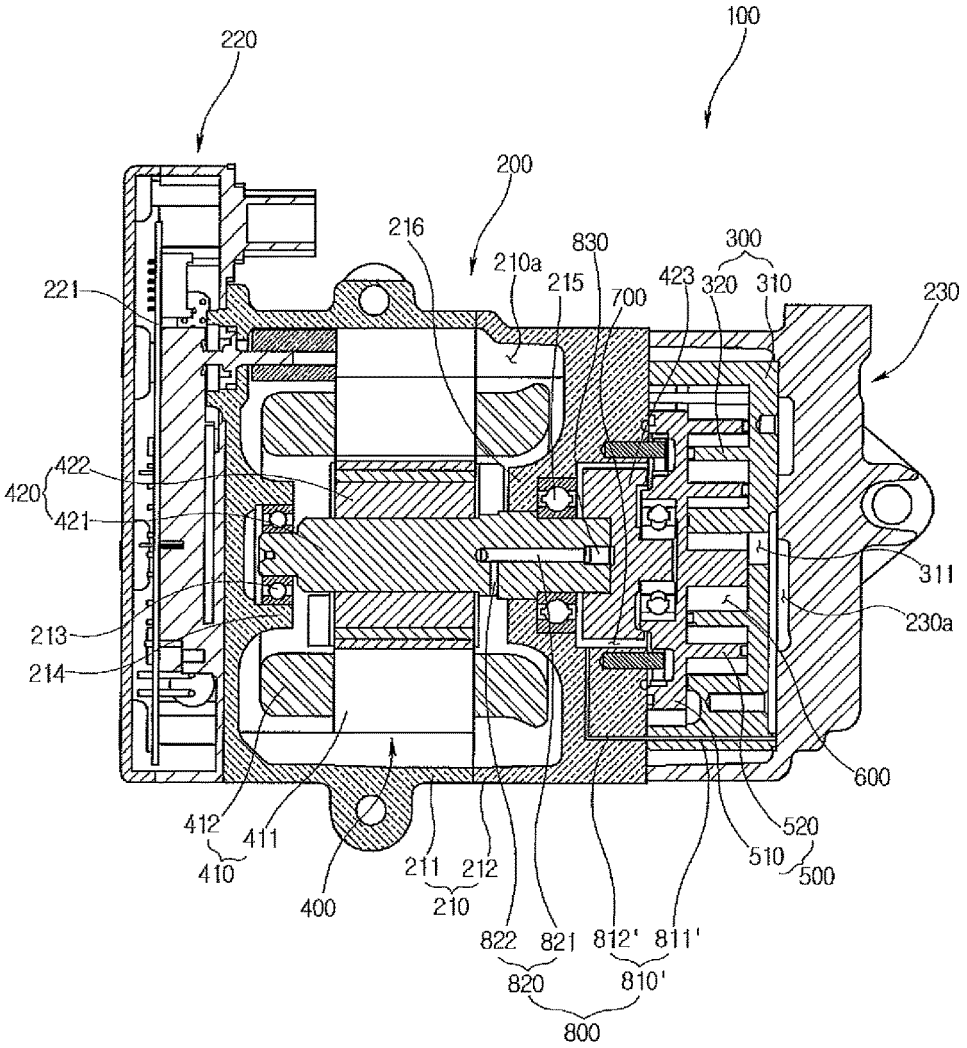
FIG. 5 is a cross-sectional view illustrating a scroll compressor according to a third embodiment of the present invention.

FIG. 5 is a cross-sectional view illustrating a scroll compressor according to a third embodiment of the present invention.

The third embodiment shown in FIG. 5 has configurations similar to the second embodiment described above with reference to FIG. 4, but differs from the second embodiment in that a first passage 810' is formed in the form of an orifice hole instead of installing of the orifice 910' of the second embodiment. Thus, the same functional configurations as those of the above-mentioned second embodiment are designated by the like reference numerals and no description will be given thereof.

In accordance with the third embodiment of the present invention, the first passage 810' is formed in the form of an orifice hole. That is, the first passage 810' itself functions as an orifice by adjusting the diameter of the first passage 810' instead of installing the separate orifice 910' as in the second embodiment. In this case, it may be possible to achieve a reduction in assembly processes according to the reduction of part numbers and thus reductions in manufacturing costs and manufacturing time, compared to the above-mentioned second embodiment.

In this case, only a 1-1 passage 811' may be made in the form of an orifice hole on one side of the fixed scroll 300, only a 1-2 passage 812' may be made in the form of an orifice hole on one side of the housing 200, or both of the 1-1 passage 811' and the 1-2 passage 812' may made in the form of an orifice hole. Moreover, any portion of each section of the 1-1 passage 811' and the 1-2 passage 812' may also be formed in the form of an orifice hole.

Figure 6:
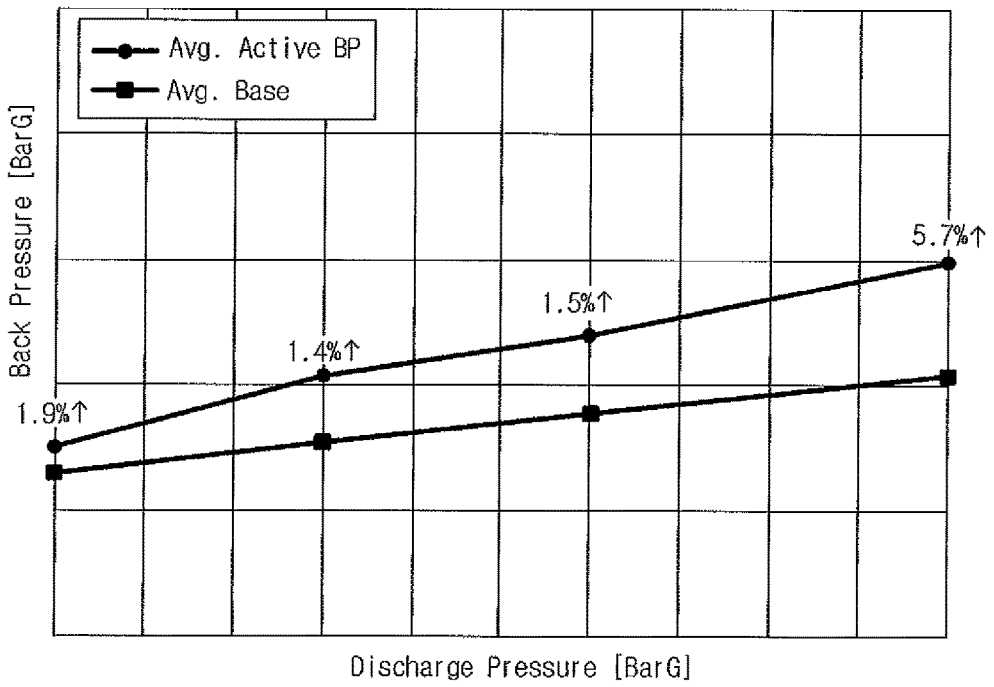
FIG. 6 is a graph illustrating a COP improvement ratio of the scroll compressor according to the embodiment of the present invention.

FIG. 6 is a graph illustrating a coefficient of performance (COP) improvement ratio of the scroll compressor, according to the embodiment of the present invention.

As described above, the pressure in the back-pressure chamber 700 is managed in connection with the pressure in the discharge chamber 230*a*. Accordingly, in accordance with the scroll compressor 100 according to the embodiment of the present invention, the orbiting scroll 500 may be supported by the pressure in the back-pressure chamber 700 without a power loss or an inner leak in an overall pressure section of the scroll, thereby enabling efficiency of the compressor to be enhanced.

FIG. 6 is a graph illustrating an improvement in such a COP, and shows a change in back pressure according to the discharge pressure in a case to which an active back pressure according to the embodiment of the present invention is applied (Active BP) or in a case if not (Base, the conventional scroll compressor shown in FIG. 1). As indicated by % in the graph, in a case to which the active back pressure is applied, it may be seen that the COP is improved by 1.9% to 5.7%, compared to a case if not.

As is apparent from the above description, in according to a preferable embodiment of the present invention, since a discharge chamber communicates with a back-pressure chamber and a pressure in the back-pressure chamber is managed in connection with a pressure in the discharge chamber by a pressure regulation unit or an orifice hole, an orbiting scroll may be supported by the pressure in the back-pressure chamber without a power loss or an inner leak in an overall pressure section of a scroll, thereby enabling efficiency of a compressor to be enhanced.

While the present invention has been described with respect to the specific embodiments, it will be apparent to those skilled in the art that various changes and modifications may be made without departing from the spirit and scope of the invention as defined in the following claims.

We claim:

1. A scroll compressor comprising:

a housing including a suction port and a discharge port formed in an outer peripheral surface of the housing, the housing defining a suction chamber and a discharge chamber, the suction chamber communicating with the suction port and the discharge chamber communicating with the discharge port;

a fixed scroll disposed in a first portion of the housing and having an outlet formed therein communicating with the discharge chamber;

a drive motor mounted to a second portion of the housing including a rotary shaft coupled thereto, wherein the drive motor is disposed within the suction chamber;

an orbiting scroll eccentrically coupled to an end of the rotary shaft and configured to revolve about the fixed scroll, the orbiting scroll cooperating with the fixed scroll to define a plurality of compression chambers;

a back-pressure chamber defined by the housing between the orbiting scroll and the rotary shaft, the back-pressure chamber configured to urge the orbiting scroll towards the fixed scroll; and a back-pressure regulation passage comprising a first passage through which the discharge chamber communicates with the back-pressure chamber and a second passage through which the back-pressure chamber communicates with the suction chamber;

a check valve disposed in the first passage, the check valve configured to selectively provide fluid communication between the discharge chamber and the back-pressure chamber; and an orifice formed in the second passage, the orifice configured to continuously provide fluid communication between the back-pressure chamber and the suction chamber.

2. The scroll compressor according to claim 1, wherein the check valve selectively opens the first passage in response to the pressure in the discharge chamber.

3. The scroll compressor according to claim 1, wherein the back-pressure regulation passage communicates with the suction chamber through the orifice.

4. The scroll compressor according to claim 1, wherein the first passage comprises a primary passage formed through a portion of the fixed scroll disposed in the first portion of the housing and a secondary passage formed in the second portion of the housing and communicating with the primary passage.

5. The scroll compressor according to claim 1, wherein the second passage comprises a primary passage formed in the rotary shaft and extending inwardly from the end of the rotary shaft in a longitudinal direction thereof and a secondary passage formed in the rotary shaft and communicating with the primary passage, the secondary passage extending from the primary passage in an outer peripheral surface direction of the rotary shaft.

6. The scroll compressor according to claim 1, wherein a flow rate of a fluid through the check valve of the first passage when the check valve is in an open position is greater than a flow rate of the fluid through the orifice of the second passage when the check valve is in the open position.

7. The scroll compressor according to claim 1, wherein the orifice is a portion of the second passage having a smaller flow area therethrough than an adjacent portion of the second passage.

8. A scroll compressor comprising:

a housing including a suction port and a discharge port spaced apart from each other and formed in an outer peripheral surface of the housing, the housing including a first portion defining a discharge chamber and a second portion defining a suction chamber, the suction chamber communicating with the suction port and the discharge chamber communicating with the discharge port;

a fixed scroll disposed in the first portion of the housing and having an outlet formed therein communicating with the discharge chamber, the outlet formed at a center of the fixed scroll;

a drive motor mounted to the second portion of the housing and including a rotary shaft coupled thereto, wherein the drive motor is disposed within the suction chamber;

an orbiting scroll eccentrically coupled to an end of the rotary shaft and configured to revolve around the fixed scroll, the orbiting scroll cooperating with the fixed scroll to define a plurality of compression chambers;

a back-pressure chamber defined by the housing between the orbiting scroll and the rotary shaft, the back-pressure chamber configured to support the orbiting scroll towards the fixed scroll; and a back-pressure regulation passage comprising a first passage through which the discharge chamber communicates with the back-pressure chamber and a second passage through which the back-pressure chamber communicates with the suction chamber, wherein the first passage comprises a primary passage formed through a portion of the fixed scroll disposed in the first portion of the housing and a secondary passage formed in the second portion of the housing and communicating with the primary passage.

9. The scroll compressor according to claim 8, wherein a first orifice is provided in the first passage.

10. The scroll compressor according to claim 9, wherein a second orifice is provided in the second passage.

11. The scroll compressor according to claim 10, wherein the back-pressure chamber communicates with the suction chamber through the second orifice provided in the second passage.

12. The scroll compressor according to claim 8, further comprising an orifice provided in the second passage.

13. The scroll compressor according to claim 8, wherein the second passage comprises a primary passage formed in the rotary shaft and extending inwardly from the end of the rotary shaft in a longitudinal direction thereof and a secondary passage formed in the rotary shaft and communicating with the primary passage of the second passage, the secondary passage of the second passage extending from the primary passage of the second passage in an outer peripheral surface direction of the rotary shaft.

* * * * *